US005543773A

United States Patent [19]

Evans et al.

[11] Patent Number: 5,543,773

[45] Date of Patent: Aug. 6, 1996

[54] TRANSFORMERS AND COUPLED INDUCTORS WITH OPTIMUM INTERLEAVING OF WINDINGS

[75] Inventors: Peter D. Evans, Birmingham; William J. B. Heffernan, Cheltenham, both of England

[73] Assignee: Electrotech Instruments Limited, Reading, United Kingdom

[21] Appl. No.: 64,038

[22] PCT Filed: Sep. 4, 1991

[86] PCT No.: PCT/GB91/01505

§ 371 Date: May 7, 1993

§ 102(e) Date: May 7, 1993

[87] PCT Pub. No.: WO92/04723

PCT Pub. Date: Mar. 19, 1992

[30] Foreign Application Priority Data

Sep. 7, 1990 [GB] United Kingdom ..... 9019571

[51] Int. Cl.[6] ..... H01F 27/28; H01F 5/00

[52] U.S. Cl. ..... 336/183; 336/229; 336/200

[58] Field of Search ..... 366/183, 200, 366/229, 232

[56] References Cited

U.S. PATENT DOCUMENTS

| | | | |
|---|---|---|---|
| 3,263,191 | 7/1966 | Arvonio . | |
| 4,103,267 | 7/1978 | Olschewski | 336/200 |
| 4,258,467 | 3/1981 | Witte | 336/183 X |
| 4,536,733 | 8/1985 | Shelly | 336/182 |
| 4,577,175 | 3/1986 | Burgher et al. | 336/183 X |
| 4,689,594 | 8/1987 | Kawabata et al. | 336/200 |
| 5,039,964 | 8/1991 | Ikeda | 333/181 |
| 5,140,706 | 8/1992 | Maeda et al. | 336/229 X |
| 5,257,000 | 10/1993 | Billings et al. | 336/229 X |
| 5,331,536 | 7/1994 | Lane | 336/183 X |

FOREIGN PATENT DOCUMENTS 2556493 6/1985 France .

*Primary Examiner*—Laura Thomas

*Attorney, Agent, or Firm*—Gardner, Carton & Douglas

[57] ABSTRACT

A transformer or coupled inductor with any arbitrary turns ratio (for example, non-integral), and optionally with multiple secondary windings, has primary and secondary windings interleaved on the same winding layer, preferably around a magnetically permeable or an air core. This is capable of giving optimum magnetic coupling, minimum leakage fields and negligible proximity effect losses. The electrical turns ratio is determined by series or parallel, or combination series-parallel, connections of the physical turns of each winding.

21 Claims, 12 Drawing Sheets

WINDING SEGMENT
One Turn
PRIMARY ($\psi$=12)
SECONDARY
12 : 1
12 : 2
12 . 2
12 . 3
12 . 4
12 . 6

$T_x=24$

TRANSFORMERS AND COUPLED INDUCTORS WITH OPTIMUM INTERLEAVING OF WINDINGS

FIELD OF THE INVENTION

This invention relates to the concept, design, construction and deployment of electrical power transformers and coupled inductors primarily for application in switch-mode power supplies, and in particular to the concept and methods of making such components whereby high frequency eddy current loss mechanisms are minimised. These devices can be used to overcome the problems of low efficiency and excessive power dissipation in high frequency switching applications.

BACKGROUND OF THE INVENTION

Conventional power transformer windings used in switch mode power supplies are usually either of the cylindrical or sandwich type (FIG. 1). The main flux produced by either winding arrangement is carried by the high permeability (usually E-shaped ferrite) core. Assuming that the current-turns product in each winding is equal (i.e. balanced mmfs, no magnetising current) the leakage flux due to the winding current is as shown (FIG. 1). This condition is approximated to in most conventional designs but applications of the present invention are not restricted to these cases. Referring to the mmf (NI) diagram it is evident that the leakage flux density:

$$B_1=(\mu_o N_1 I_i)/L_c$$

is at a maximum in the air gap between windings. The effect of this leakage flux is to induce eddy currents in the windings which become more severe as the flux density increases. Referring to the flux-linkage (Nϕ) diagram, the distribution of the leakage inductance (flux linkage per amp, Nϕ/I) is shown. The leakage inductance can be visualised as the solid of revolution of the Nϕ diagram about the central axis.

Eddy Current Winding Loss

The two main mechanisms contributing to a.c. winding loss are well known. The skin effect is caused by the current flowing within a conductor setting up a magnetic field which then induces eddy currents in the conductor. The direction of eddy current flow is such as to cancel out the main current in the centre of the conductor but reinforce it as the edges (FIG. 2). Thus the current tends to flow in a skin, around the outside of the conductor, and the effect is characterised by a skin depth, δ, defined by:

$$\delta=[f\cdot\pi\cdot\mu_O\cdot\sigma]^{-1/2}$$

where f=frequency, μo=permeability of free space and σ=conductivity of conducting material.

The proximity effect (1) is caused by the leakage flux due to all the windings (as in FIG. 1) inducing eddy currents in each winding in such a direction as to cancel the main current at the outer edge and to reinforce it at the inner edge (FIG. 3).

Hence the action of these mechanisms is to force the current to flow non-uniformly in the conductors, increasing the effective resistance. The resistance increase due to skin effect depends entirely on conductor dimensions, material and operating frequency whereas proximity effect depends on overall transformer construction and geometry also. Proximity effect is hence less easy to quantify but one method has been presented by Dowell (1).

It is generally the aim of power transformer design to minimize the leakage flux density, thus minimizing proximity effect losses, and hence minimizing a.c. resistance, and leakage inductance. (In High Frequency Power Transformers this is generally to reduce winding conduction losses and uncoupled magnetic energy storage rather than to reduce voltage regulation with load, as in the case of mains frequency transformers). Leakage flux density, $B_1$, can clearly be reduced by:

i) increasing $L_c$, the leakage path length, indicating a long thin cylindrical arrangement or a low wide sandwich transformer.

ii) reducing effective N by interleaving primary and secondary layers giving a modified mmf diagram such as that of FIG. 4.

iii) some combination of the above.

Additionally eddy current losses can be mimimized by using conductors less than two skin depths thick, or multiple stranded conductors such as Litz wire.

For very low Leakage transformers, particularly in radio equipment, a bifilar winding arrangement is used in which the primary and secondary windings are twisted together prior to winding. This ensures that, for an N turn winding, the peak mmf is never greater than one Nth of its value in a single layer conventional arrangement; i.e. each primary turn is interleaved with a secondary turn. Such transformers are usually wound on a toroidal core to give a closed main-flux path and have unity turns ratio.

SUMMARY OF THE INVENTION

The invention provides a transformer or coupled inductor with any turns ratio, as defined in claims 1, 2, 10 or 13, and corresponding methods of manufacture. By interleaving individual physical turns of the primary and secondary windings on the same winding layer, preferably around a permeable or air core, there is the possibility of optimal magnetic coupling, minimal leakage fields and negligible proximity effect losses. Preferably each winding consists of N physical turns of conductive material around a core which may be of soft magnetic material (e.g. ferrite or iron powder), the electrical turns ratio being determined by series or parallel, or combination series-parallel, connections of the physical turns of each winding. Whereas conventional, bifilar windings require the primary-secondary turns ratio to be unity, the invention allows the electrical turns ratio to take any desired value, including non-integral values.

The conductors for each physical turn are preferably optimally dimensioned to minimize or control winding losses.

More than one layer of windings thus interleaved may be employed, the primary/secondary interleaving preferably being both in each of the layers and also from layer to superimposed layer.

Any series, parallel, or series/parallel combination or array of such transformers or coupled inductors, may be used so as to optimise heat transfer or to control stray magnetic fields.

In the transformer or coupled inductor, or array of such transformers or inductors, a portion of each or any physical turn is preferably formed by a printed, etched, plated or otherwise formed conductor on a substrate material; and the invention also provides a corresponding method of manufacture.

The substrate may be a flexible or a preformed substrate. Multiple layer substrates are advantageous for more complex windings.

A portion of each or any physical turn is preferably formed by an ultrasonically or thermosonically welded, soldered, silver soldered or otherwise welded or attached conductor looped over a core; and the invention also provides a corresponding method of manufacture.

Thus the invention provides a method of manufacturing a transformer or coupled inductor, in which a portion of at least one physical turn is constituted by a conductor formed on a substrate material, and in which each winding consists of physical turns of a conductive material (e.g. metal wire or ribbon) around a core, including the step of forming a portion of each physical turn as a loop of the conductive material over the core and bonding it at its ends to the conductors which are formed on the substrate (e.g. by ultrasonic welding, welding, soldering, or another appropriate method).

The looped conductors may be positioned in an insulating former designed to give compliance with national and international standards for insulation and safety isolation.

Alternatively, this portion of each or any physical turn may be formed by a printed, etched, plated or otherwise formed conductor on the core material; and the invention also provides a corresponding method of manufacture.

In each of these aspects of the invention, a portion of each or any physical turn may advantageously consist of a punched, pressed, plated, or otherwise manufactured preform.

Further, in each transformer or coupled inductor or array thereof, it is preferred that a toroidal core or cores is/are used.

In each such transformer or coupled inductor, any or all of the windings are preferably terminated in the centre of the core, allowing optimal current distribution in the winding and reducing losses. This is especially advantageous in the case of windings employing parallelled turns.

Secondary side rectifier diode/s and/or any other components may be situated in the centre of the core, and the windings adapted for connection thereto. This is particularly relevant to a step-down transformer/coupled inductor. Additionally, where parallelled secondary turns are employed, individual rectifier diodes may be used with each turn, or group of turns, with inherent current sharing.

Primary side switching device/s and/or any other component/s may be situated in the centre of the core. Again, this is particularly relevant to a step-up transformer/coupled inductor.

The core material is advantageously a permeable ferrite, optionally with distributed 'air' gaps, where 'air' means any material of permeability lower than the said ferrite.

The core may however be of a powdered iron or other powdered permeable material (e.g. Moly-permalloy) construction; or of amorphous metal material, strip-wound or solid.

The transformer or coupled inductor or array thereof may be air-cored or wound on a non-permeable former.

With any of these core constructions, the core cross section is ideally arranged so as to facilitate manufacture of the component, e.g. by use of a domed shape or other convex shape.

Embodiments of the invention will now be described, by way of example only, with further reference to the accompanying drawings in which:

BRIEF DESCRIPTION OF THE DRAWINGS

FIG. 14(*b*) is the transformer equivalent circuit for the pattern of FIG. 14 (*a*);

FIG. 15(*b*) shows multiple foil/ribbon conductors on the same former as FIG. 15(*a*), for comparison;

FIG. 16(*b*) is an equivalent circuit diagram of the transformer of FIG. 16 (*a*);

FIG. 17(*b*) is a graph corresponding to FIG. 17(*a*) but representing leakage inductance in H (from 0 to $9\times10^7$ H);

FIGS. 17(*c*) and 17(*d*) are graphs corresponding to FIGS. 17(*a*) and 17(*b*) but in a short circuit test of an interleaved toroid transformer embodying the invention;

DETAILED DESCRIPTION OF THE INVENTION

Figure 1A:
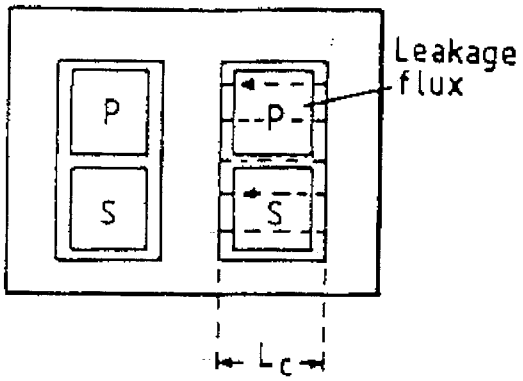
FIGS. 1(*a*) and 1(*b*) are diagrams in axi-symmetric section of conventional tranformer winding techniques, FIG. 1(*a*)) showing sandwich type winding and FIG. 1(*b*) showing cylindrical winding.
Figure 1B:
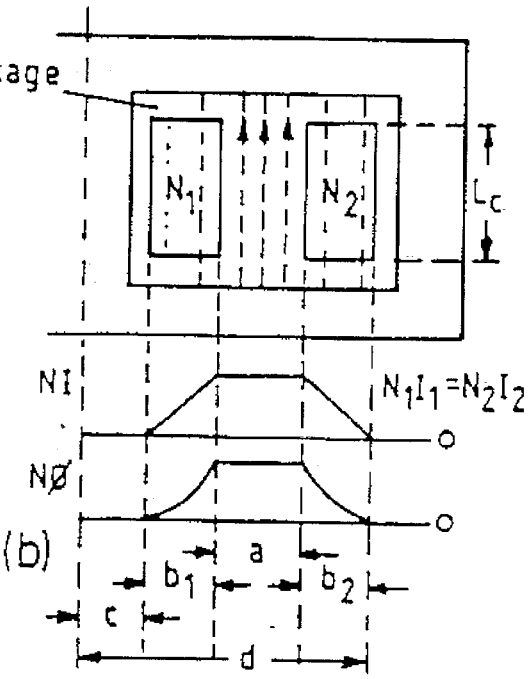
Figure 2:
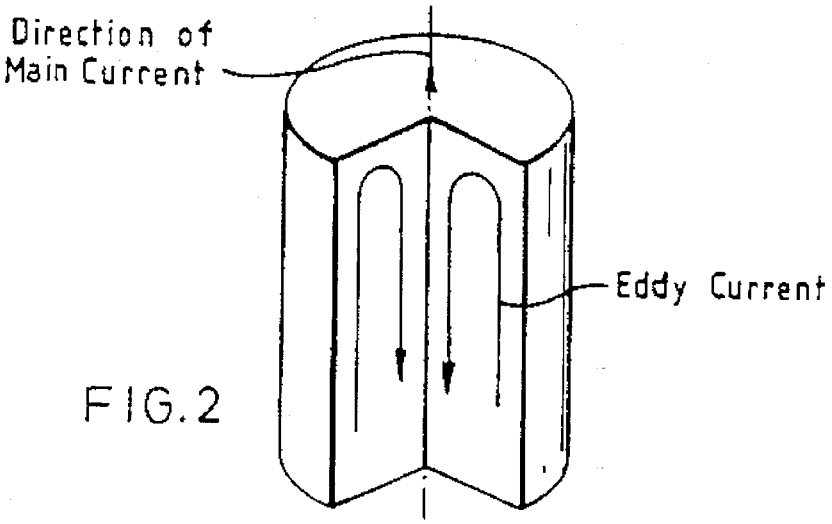
FIG. 2 is a diagram showing the a.c. skin effect in a standard conductor.
Figure 3:
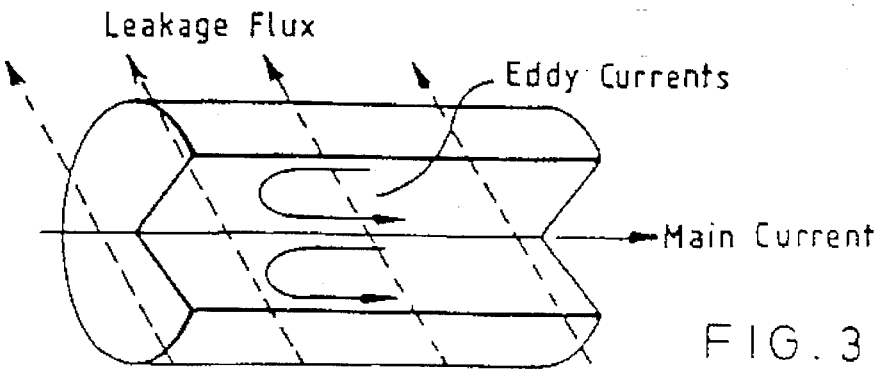
FIG. 3 is a diagram showing the proximity effect in a standard conductor, current being redistributed towards the bottom edge of the conductor.
Figure 4:
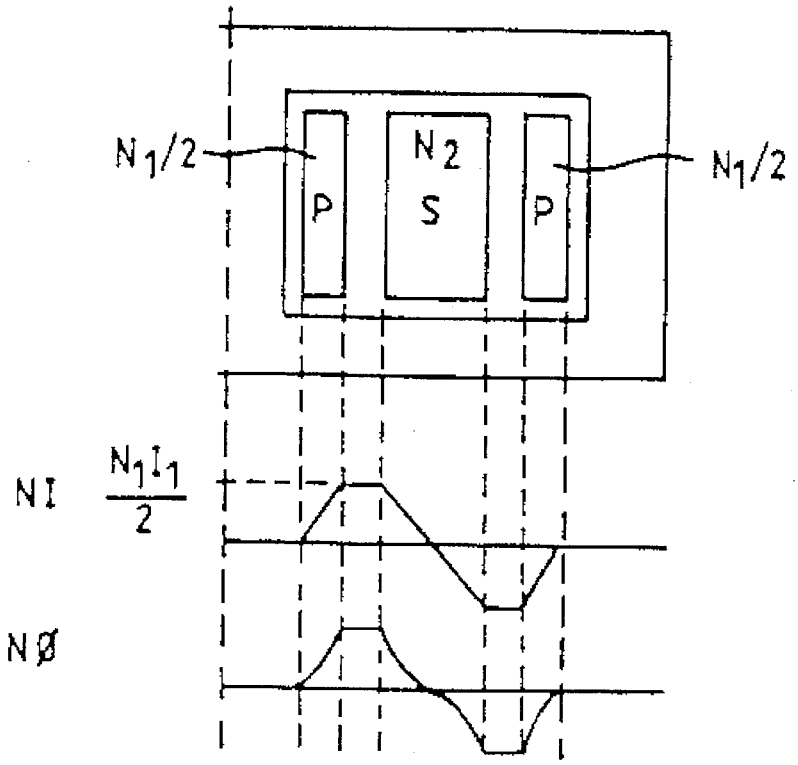
FIG. 4 illustrates the reduction of mmf and leakage inductance by interleaving windings in a transformer.
Figure 5:
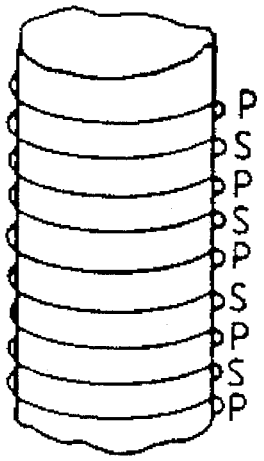
FIG. 5 shows the general arrangement of primary and secondary turns in a simple two winding case.
Figure 6A:
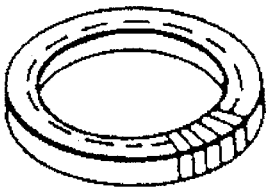
FIGS. 6(*a*), 6(*b*), and 6(*c*) and 6(*d*) show possible generalised structures of transformers embodying the present invention, FIG. 6(*d*) showing an interleaved planar spiral transformer.
Figure 6B:
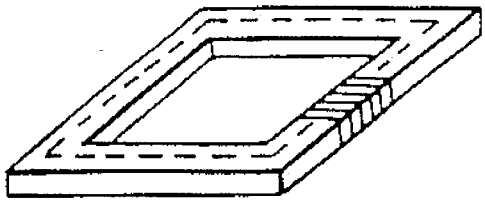
Figure 6C:
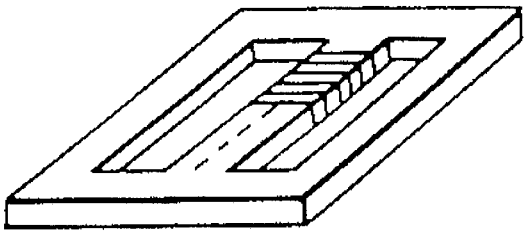
Figure 6D:
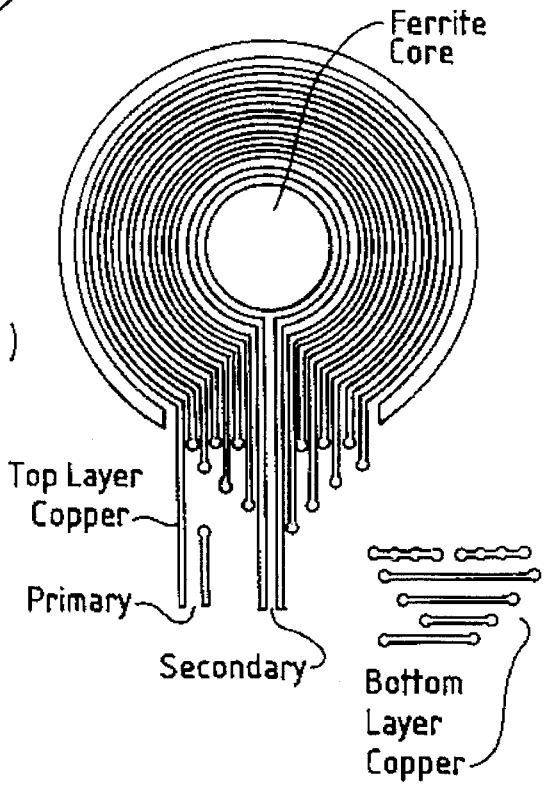

In embodiments of the present invention the primary or primaries and secondary or secondaries of the transformer may be interleaved as in a bifilar or multifilar arrangement, i.e. one primary turn is adjacent to two secondary turns and vice versa (see FIG. 5). By connecting the turns of each winding in a suitable series/parallel arrangement, any reasonable combination of turns ratio and peak mmf is possible. In this way it is clear that proximity effect is virtually eliminated since the mmfs driving the leakage flux become inconsequential as the number of turns is increased. Furthermore, by choosing appropriately dimensioned conductors for each turn, skin effect losses can also be controlled; the total number of turns can be adjusted to give any required d.c. resistance.

Note that the expression 'number of turns' as used here indicates the physical number of turns for each winding (which can be the same for all windings) and not the electrical number which is determined by the series/parallel connections.

The optimum shape for the core of the transformer (which is likely to be of a soft magnetic permeable material, possibly ferrite) is a toroid. In such a structure the physical relationship of any one turn to all the others is ideally identical, i.e. the sum of the mutual leakage flux linkages between any given turn and all other turns is identical. In this case, provided the completed transformer windings are connected in a symmetrical fashion, current will be shared perfectly between each turn of every parallel connected winding; thus winding resistance will be minimized. There are also non-optimum cases where primary or secondary turns are not symmetrically positioned. In these cases good current sharing can still be achieved.

However, the technique may also be advantageous in any other core shape including E-cores employing conventional or planar spiral windings (see FIG. 6). The interleaved planar spiral transformer of FIG. 6(*d*) is particularly interesting; the conductor width may be varied to give exact current sharing in the secondary turns despite variations in turn length.

Figure 7:
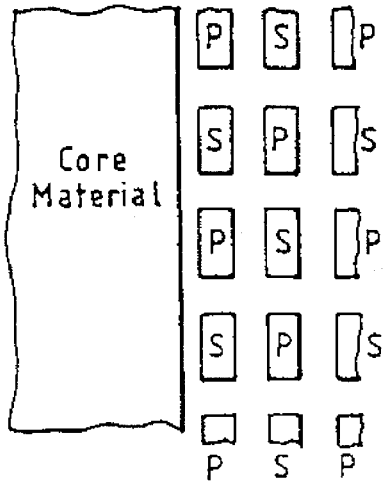
FIG. 7 is a diagram of part of a transformer illustrating the concept of multiple layering.

The device thus far described is a transformer consisting of only one layer of winding. However this mmf cancelling technique can be applied to any number of layers (see FIG. 7); here primary and secondary turns are interposed both on each layer and also on alternate layers resulting in minimal leakage flux in either axis. Additionally this method is applicable to coupled inductors (also known as flyback transformers). In such a case, primary and secondary windings conduct alternately so mmf cancellation does not take place—nevertheless the coupling between windings is considerably enhanced leading to very low leakage inductance; furthermore the leakage flux cutting each winding will be identical giving equal primary and secondary conduction losses leading to minimum total loss. In the case of the inductor, the core may preferably be made of low permeability magnetic material, e.g. iron powder, or of high permeability ferrite with distributed air gaps for energy storage. As with the transformer, the optimal shape is a toroid, although any shape is possible (e.g. shape c) of FIG. 6 in which the centre of the core is of low permeability material with a highly permeable 'magnetic shunt' round the outside).

For higher power throughput levels and higher frequencies, the physical size of typical transformers and inductors becomes such that the main (core) flux density has to be kept well below the saturation level of the material, for acceptable core temperature rise in operation. This is because total core losses, for a given flux density, are proportional to core volume, whereas heat transfer from the core is related directly to core surface area. Hence by utilizing a series/parallel arrangement of a number of transformers or inductors, the surface area for a given volume can be increased and the material can be used more effectively.

Non-integer Turns Ratios and Multiple Secondary Windings

Most turns ratios can be achieved under the proposed system, both step up and step down, by using series-parallel combinations of turns. Examples of these are given in FIG. 8, in which, for demonstration purposes, the primary winding has twelve series-connected turns ($N_p$=12).

Figures 8A, 8B, 8C, 8D:
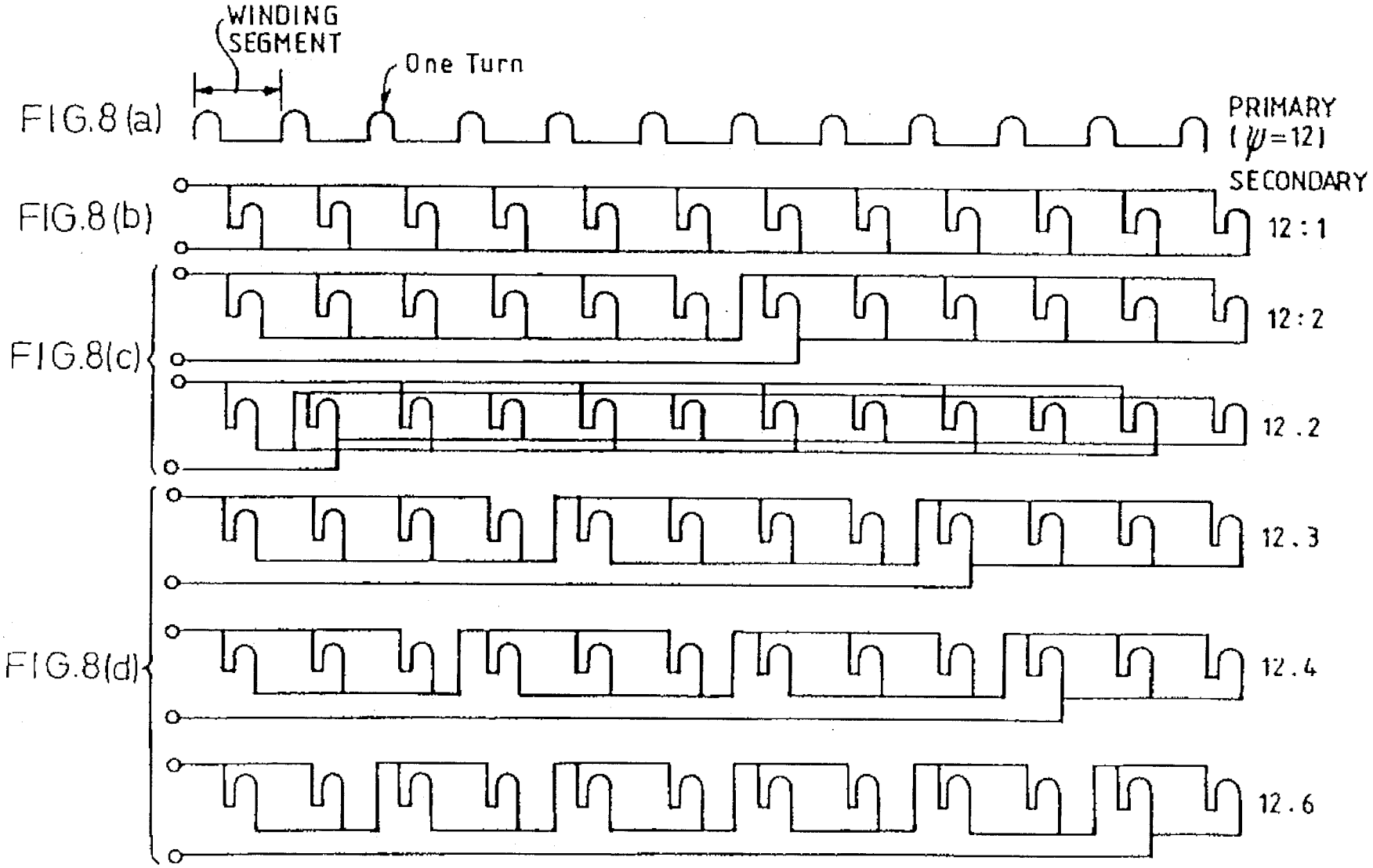
FIGS. 8(*a*) to 8(*g*), 9(*a*) and 9(*b*), 10 and 11 illustrate winding schemes embodying the invention for non-integer turns ratios in a transformer, multiple secondary windings being shown in FIGS. 10 and 11.
Figures 8E, 8F, 8G:
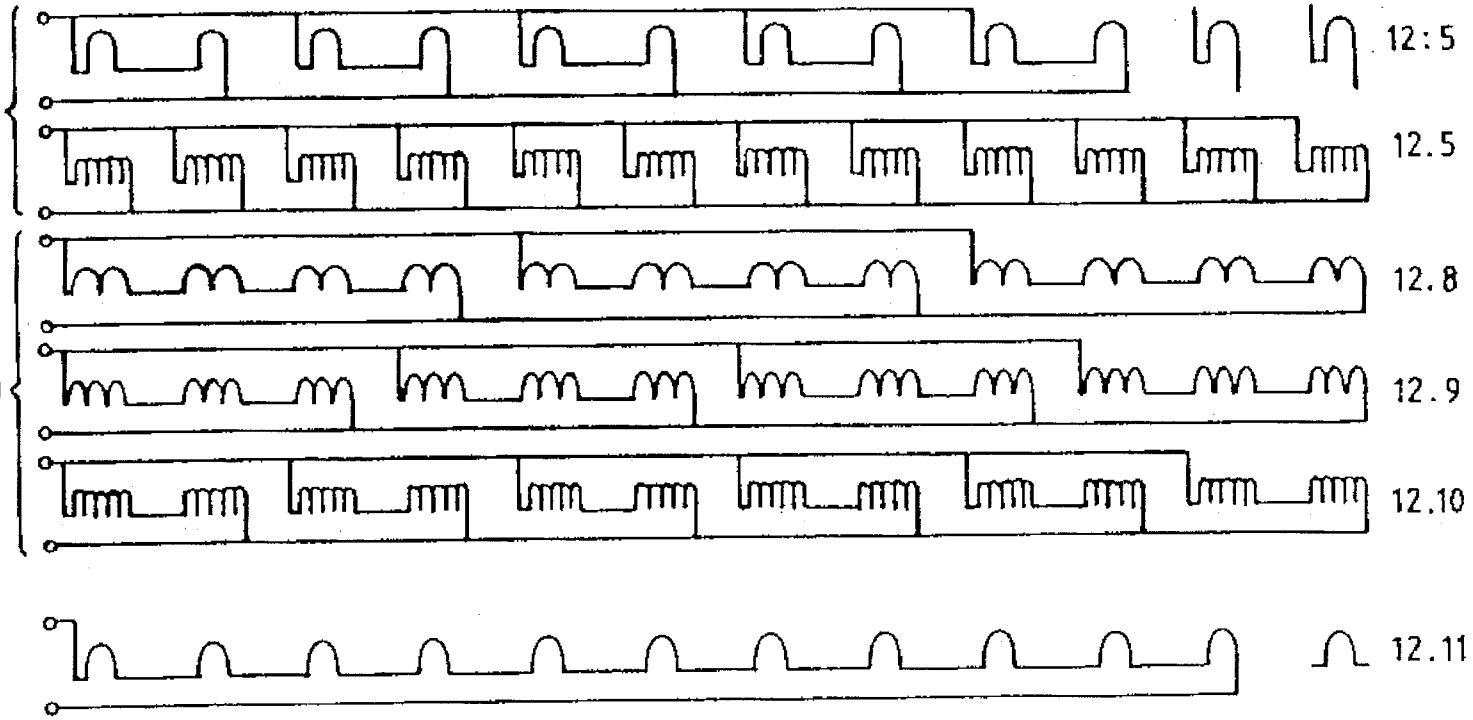

The 12:1 arrangement is a simple matter of connecting the secondary turns ($N_p$ of them) in parallel as shown in FIG. 8(*b*). The 12:2 ratio is a matter of paralleling up six turns, twice, and connecting the parallel sets in series. There are numerous alternatives for selecting the turns to be connected in parallel, and two examples are shown in FIG. 8(*c*). Physical convenience in laying out the substrate is likely to be a major influence in choosing the most suitable interconnection pattern. Similar series-parallel systems are available for other integer turns ratios, namely 12:3, 12:4 and 12:6 for the present case, as shown in FIG. 8(*d*).

For the non-integer turns ratio 12:5, the winding becomes more complex. One method is to put five series-connected turns in each winding segment and to connect them all in parallel, as shown in FIG. 8(*e*). A simplified, but approximate method is also shown in FIG. 8(*e*) in which two winding turns are not used. Similar techniques can be used for the ratios 12:7 and 12:11.

Further series-parallel connection techniques can be used for ratios such as 12:8, 12:9 and 12:10, as shown in FIG. 8(*f*). For 12:8 there are two series connected turns per segment. Four of these segments are connected in series and three such sets of series connected segments are connected in parallel. Similar techniques are shown in FIG. 8(*f*) for 12:9 and 12:10 ratios. For a ratio close to unity, such as 12:11, the most likely practical solution is for one turn to be unused, as shown in FIG. 8(*g*).

For a transformer with more than one secondary winding, to produce different voltages with different turns ratios, the winding techniques described in the preceding section can be used to obtain satisfactory winding arrangements. One formal procedure for obtaining winding patterns which result in mmf minimization for each primary turn (optimum interleaving) is given below.

a) Definitions i) Number of primary electrical turns, $N_P$ ii) Number of physical primary turns, $T_P=N_P$ iii) Number of winding segments, $S=N_P$ iv) Number of electrical turns in $k^{th}$ secondary $N_k$ v) Number of physical turns in $k^{th}$ secondary, $T_k$ vi) Number of series turns of $k^{th}$ secondary in each winding segment (series factor), $\sigma_k$ vii) Number of segments connected in series in each parallel set (segment factor), $\zeta_k$ viii) Number of identical sets of series winding which are parallel connected to form the $k^{th}$ secondary (parallel factor), $\psi_k$ b) Procedure i) Calculate $N_P$ by the usual methods ii) Calculate the values of $N_k$, for all secondaries iii) Reduce turns ratio $$\frac{N_k}{N_p} \rightarrow \frac{\sigma_k}{\psi_k} \quad \left(\text{e.g. } \frac{8}{12} \rightarrow \frac{2}{3}\right)$$

iv) Calculate $$\zeta_k = \frac{N_k}{\sigma_k} = \frac{N_p}{\psi_k}$$

v) Calculate $T_k=\psi_k N_k=\sigma_k N_p$

Evidently in cases where $\sigma_k$ is unity (integer turns ratio) $T_k=T_p$. This is advantageous, to minimise the number of turns. Hence, in general, the value of $N_p$ may be chosen to allow minimum values of $\sigma_k$, for the secondaries required. Again, taking $N_p=12$ as an example, a $\sigma_k$ of unity is achieved for $N_k=1, 2, 3, 4, 6, 12$, ie factors of $N_p$. On the other hand, if $N_k=8$, $\sigma_k=2$, $\psi_k=3$, $\zeta_k=4$ and $T_k$ 24. Similarly, if $N_k=5$, $\sigma_k=5$, $\psi_k=12$, $\zeta_k=1$ and $T_k=60$. It may be desirable to avoid certain values of $N_k$, or to use non-optimum interleaving schemes with such secondaries. Examples for $N_k=6$ and $N_k=8$ are depicted in FIGS. 9(*a*) and (*b*) respectively, below.

Figure 9A:
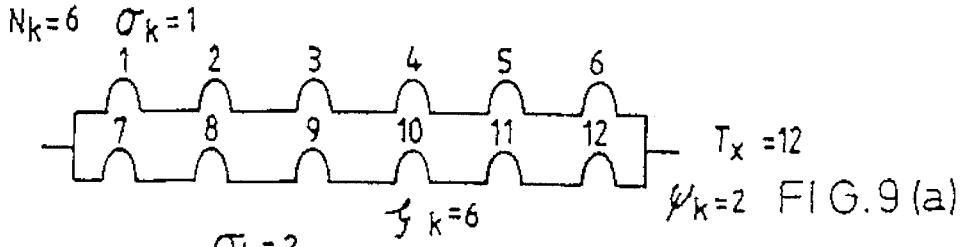
Figure 9B:
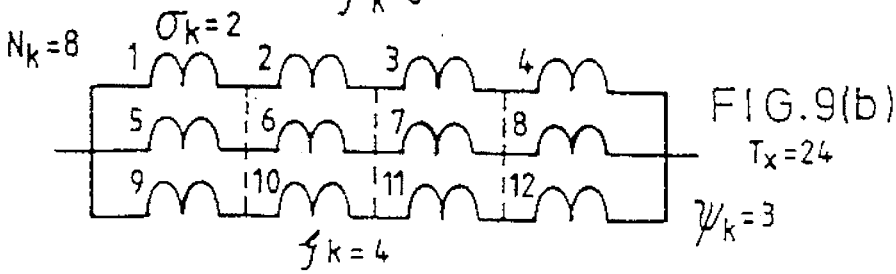

Note that the segment numbering used in FIGS. 9(*a*) and (*b*) is arbitrary—segments can in principle be connected in any suitable sequence. Additionally, the parallel links shown as dotted lines may have benefits in some applications.

For transformers with multiple secondary windings the number of secondary turns can be calculated and a suitable arrangement devised, using the technique described above. This gives solutions in which each winding segment contains turns from all windings. This provides for good current sharing among turns and serves to minimise the a.c. resistance. An example of this type of arrangement is given in FIG. 10 with a twelve turn primary and one, three and eight turns secondaries. There is mmf cancellation every 30°($\pi/6$).

Alternative winding systems also exist in which the multiple secondary windings are arranged in such a way that some secondary windings are completely or partially absent from some winding segments. An example of this is shown in FIG. 11 for a twelve turn primary with a 5 turn secondary, a centre tapped 2 turn secondary and a centre tapped one turn secondary. In these systems the windings are usually arranged symmetrically to ensure good current sharing, but leakage flux within each winding segment and a.c. winding resistance are not minimized; instead the mmf driving leakage flux is minimized every $\chi$ winding segments, where $\chi$ is an integer, $\chi$ being equal to three in the example in FIG. 11. In general therefore mmf is minimized every ($\chi$/S). $2\pi$ radians yielding $\pi/6$ for FIG. 10 (as indicated above) and $\pi/2$ for FIG. 11. For a given turns ratio, the higher the value of (S/$\chi$), known as the symmetry factor, the lower the peak value of mmf and hence the lower the leakage inductance and a.c. resistance of the transformer. However, as (S/$\chi$) increases, so does the total number of physical turns $T_{tot}$ leading to a design trade-off between the two.

Figure 10:
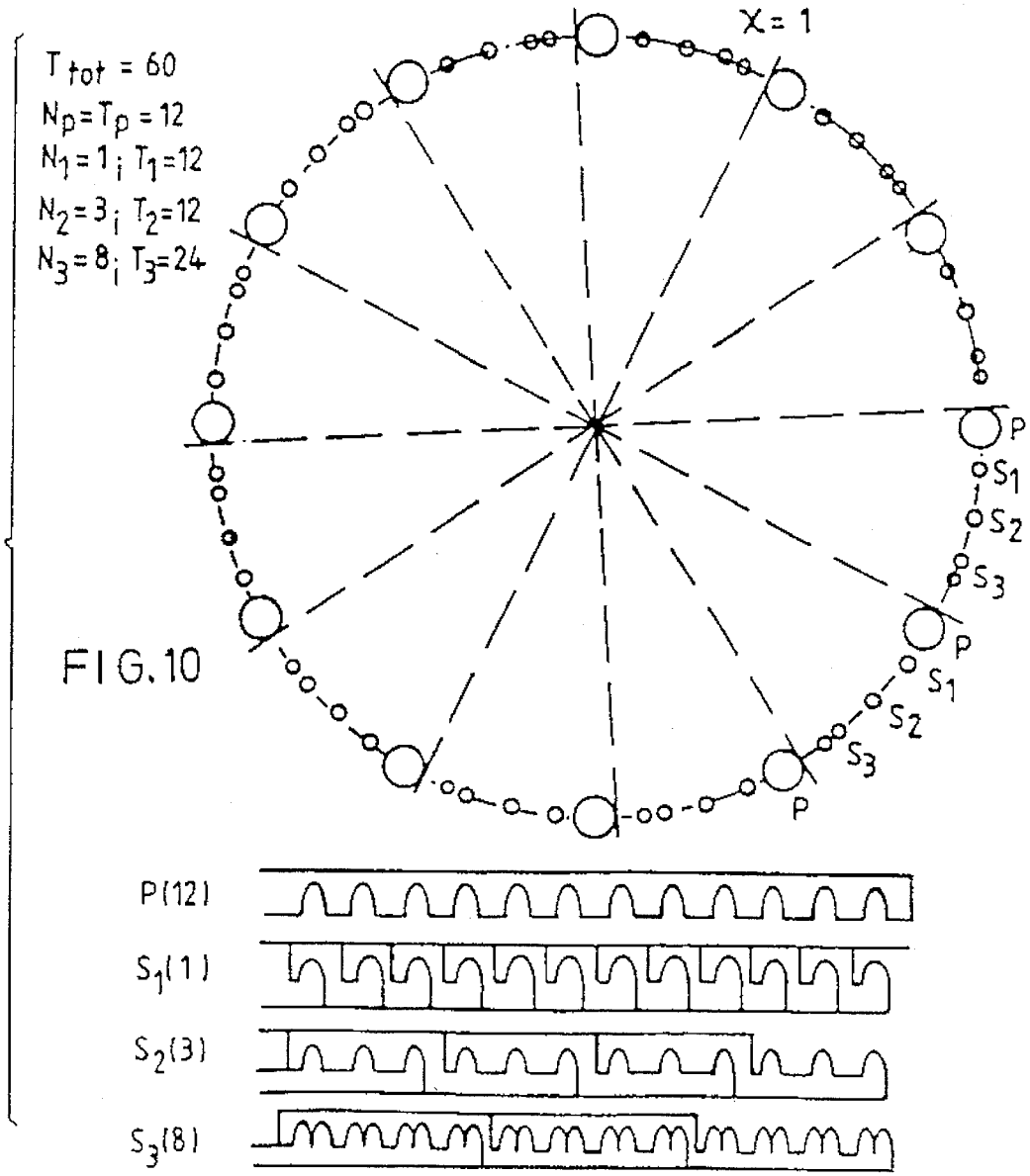
Figure 11:
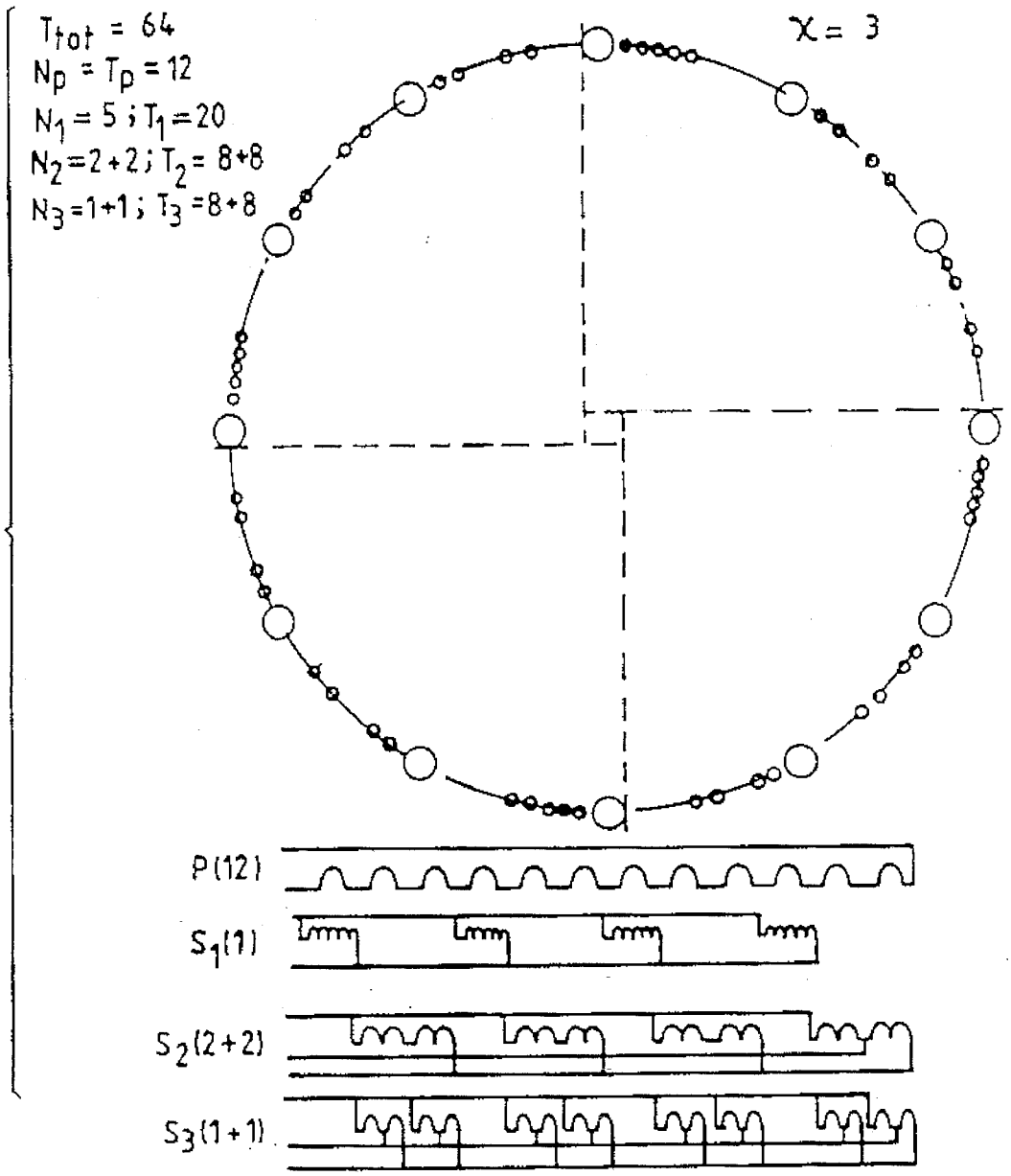

To provide an interwinding screen, not shown in FIG. 10, extra turns with one end earthed and the other end floating are interspersed between the primary and secondary conductors; ideally located on each side of every primary turn.

Manufacturing techniques

Figure 12:
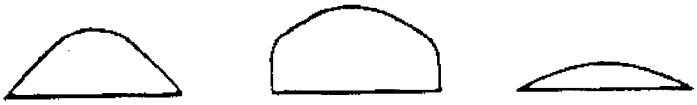
FIG. 12 is a diagram of three different possible core cross-sections which would facilitate winding.
Figure 13:
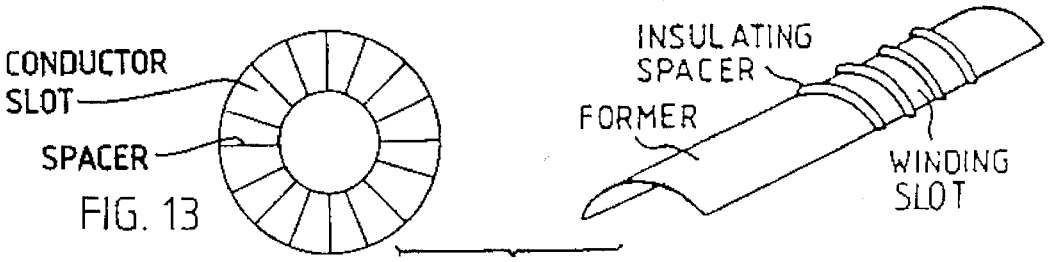
FIGS. 13(*a*) and 13(*b*) show toroidal (in plan view) and rod (in perspective view) core configurations for a winding former.

A transformer or inductor as described can be made by thick film printing, plating or etching a pattern of conductors (e.g. copper) on a substrate material which is electrically insulating but preferably thermally conductive (e.g. Alumina, Beryllia, Aluminium Nitride). If the substrate is not a good thermal conductor, such as FR4 or Kapton, then thermally conducting vias may be provided for good thermal properties. Such a pattern or multi-layered patterns may include the terminations for the transformer or inductor and determine the series or parallel connections of the individual turns. A suitable insulation layer(s) may then be placed on top of these conductors on which is placed the core itself. The turns are then completed over the core—these may take the form of conductive wire, ribbon or foil bonding leads, or of printed, plated or etched conductors which may be attached directly to the core or to a flexible substrate; additionally, particularly in the case of a single electrical turn primary or secondary winding, the parallel turns may be formed by a single conductive pressing or an etched, plated or printed preform. The cross section of the core over which the windings are placed may advantageously be shaped so as to facilitate "winding" the device, for example, with a domed profile (FIG. 12). Additionally an insulating former or formers in which to run the "winding/s" may be used, shaped so as to fit over the core, which may not only aid routing of conductors during manufacture, but also provide electrical insulation (e.g. FIG. 13). Such a former can be designed to provide the necessary creepage and clearance distances for safety and other isolation/insulation standards. A number of such formers placed on top of each other may be used in the case of multiple layers. The former described may be incorporated as part of the core itself although this is likely to be less satisfactory electromagnetically. In some cases it may be advantageous to place one or more winding/s directly on to the core or former, with conventional techniques, prior to attachment to the substrate, particularly where many electrical turns are involved.

Figure 14A:
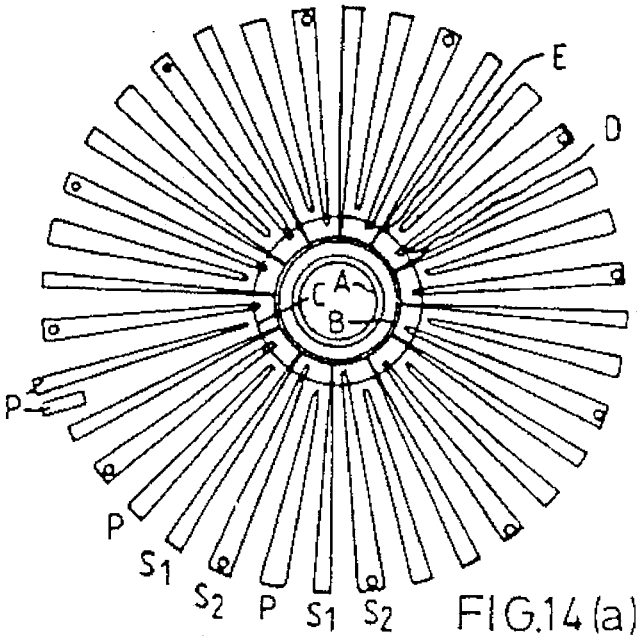
FIG. 14(*a*) illustrates in plan view a substrate conductor pattern for a transformer embodying the invention.
Figure 14B:
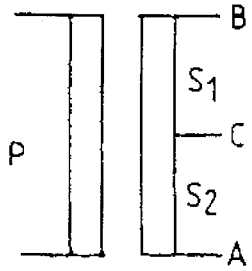
Figure 15A:
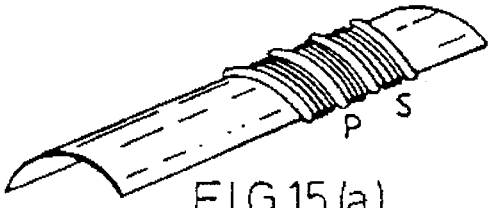
FIG. 15(*a*) shows multiple strands in parallel, on a former.
Figure 15B:
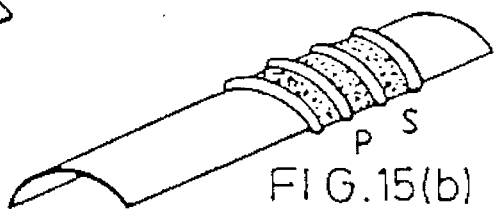

For a better understanding of the present invention, and to show how it may be bought into effect, reference will now be made, by way of example, to the construction of a toroidal transformer with a 12 turn primary and centre-tapped single turn secondary detailed in the accompanying drawings:

In FIG. 14(*a*) a pattern of etched, plated or printed conductive tracks (in this case etched copper) is formed on a substrate material (e.g. alumina). The thickness of the conductor material is typically 1.5 to 2 times the skin depth at the desired frequency (in this case 70 μm copper, equivalent to 1.5 skin depths at 2 MHz). Notice that the primary part turns are not interconnected, as they will all be electrically in series, whereas the secondaries are all paralleled on the substrate. The secondary turns may all be connected inside the toroid by circular conductors (rings) as shown. In this case the outer of the three rings, labelled C, may be printed, plated or etched on a different layer from ring B, possibly with vias (inter-layer connections) at points D. Alternatively printed, sprayed or adhesive insulation may be used either over the whole substrate (except for connection pads) or just at the crossovers marked E (at which the conductive paths cross each other). Otherwise ring C may be formed by wire or ribbon bonds with or without insulation at the crossover points E. One other option is to dispense with these rings altogether and to run multiple bond conductors from each paralleled radial conductor to appropriate bonding pads in the centre of the toroid (e.g. direct bond to rectifier diodes). Similarly conductor ring/s may be used on paralleled conductors outside the toroid; this may be useful for bonding purposes where a preformed secondary winding is employed. The size of the conductive pattern depends on the desired winding resistance, the dimensions of the core and the required minimum spacing (for electrical isolation) between primary and secondary conductors. (Currently for safety isolation from mains supply this must be greater than 400 μm). A permeable soft magnetic core (in this case a commercially available toroid of ferrite coated with insulation) is located on top of the substrate. In practice, printed, sprayed or adhesive layer/s of dielectric insulation may be added to the conductor pattern before placing the core, leaving suitable bond-pads for connection. The core may be adhesively attached (e.g. with thermally conductive adhesive) to the substrate to give mechanical strength and good heat transfer. Means for completing the turns (e.g. ultrasonic, thermosonic, thermocompression wire or ribbon bonder or solder/silver soldering, resistance or laser welding equipment) are then employed (in this case soldered copper wire is used). If foil or ribbon conductors are used the thickness is again typically 1.5 to 2 times skin depth. The width of conductors depends on required resistance and minimum spacing. If circular wire conductors are used, conductor diameter is typically twice skin depth (overall diameter with enamel insulation being roughly 130 μm in this case). Note that in order to reduce resistance with circular wire, (FIG. 15(*a*)) multiple strands can be connected in parallel within a single turn to approximate to a wide foil or ribbon (FIG. 15(*b*)). (Ideally each turn should be a single wire with alternate primary and secondary turns; however this often becomes impractical because of minimum spacing requirements and the added complexity of a combination of series and parallel primary turns. In the present case the reduction of the peak mmf, driving leakage flux, to one twelfth of its usual value is sufficient to render proximity effect losses negligible). Of course, a combination of the techniques of FIGS. 15(*a*) and 15(*b*) could be used.

Figure 16A:
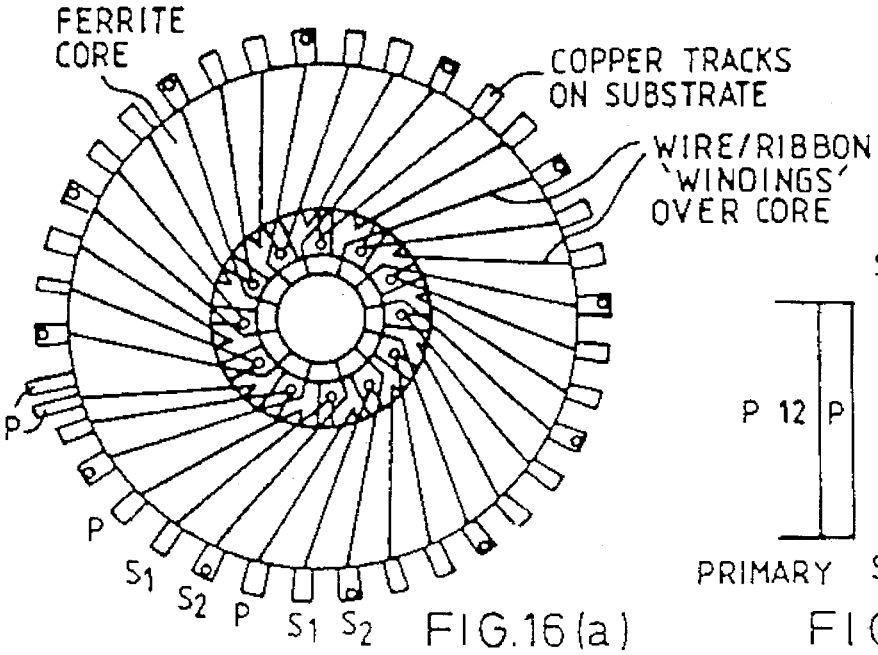
FIG. 16(*a*) is a plan view of a completed transformer with core and windings.
Figure 16B:
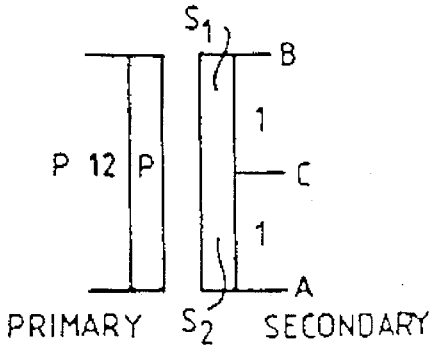
Figure 17A:
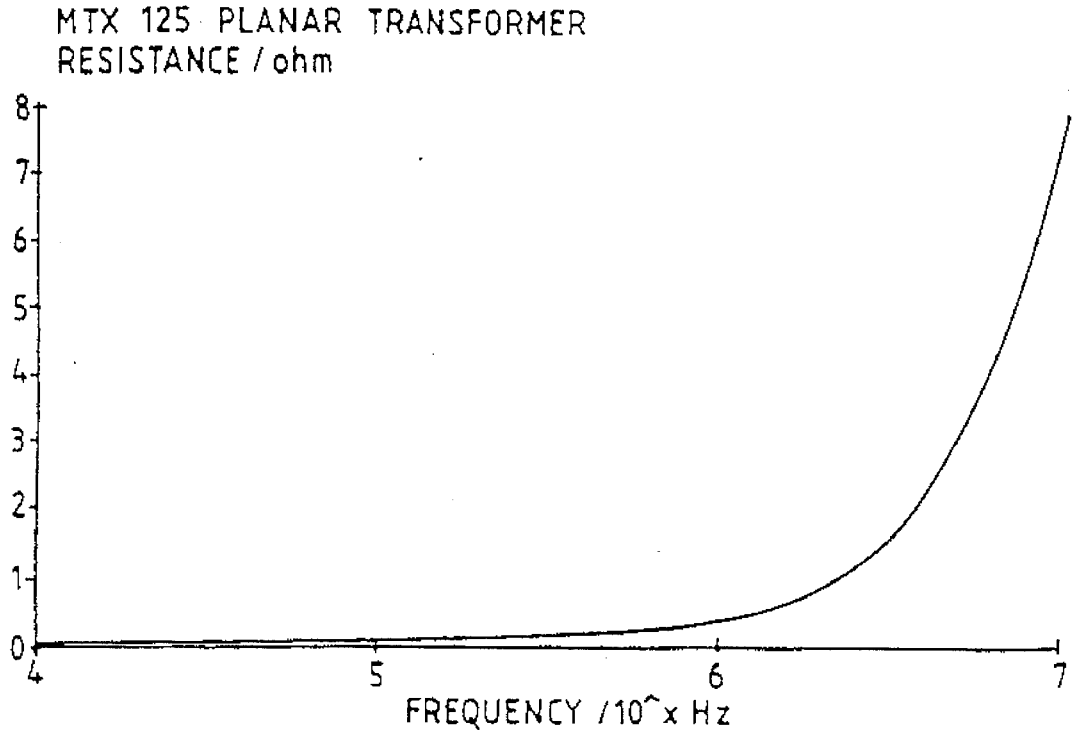
FIG. 17(*a*) is a graph of a.c. resistance (in ohms) against log. frequency (to the base 10) in Hz, in a short circuit test of a commercially available planar spiral transformer known as the MTX125 Power Transformer.
Figure 17B:
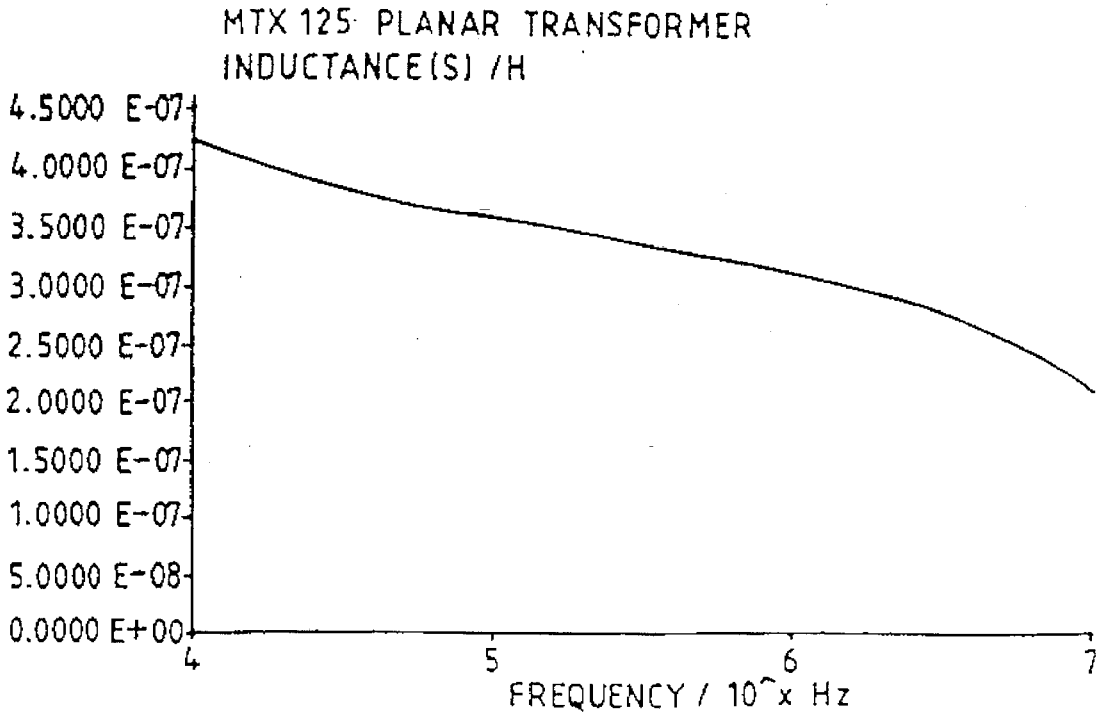
Figure 17C:
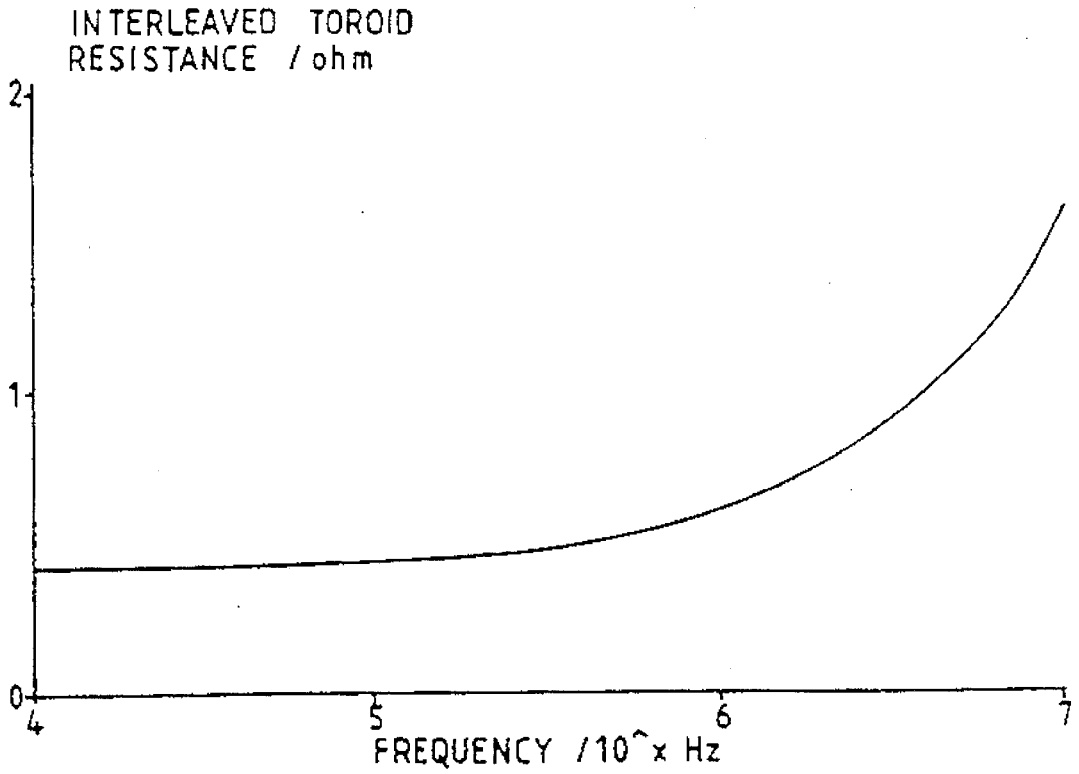
Figure 17D:
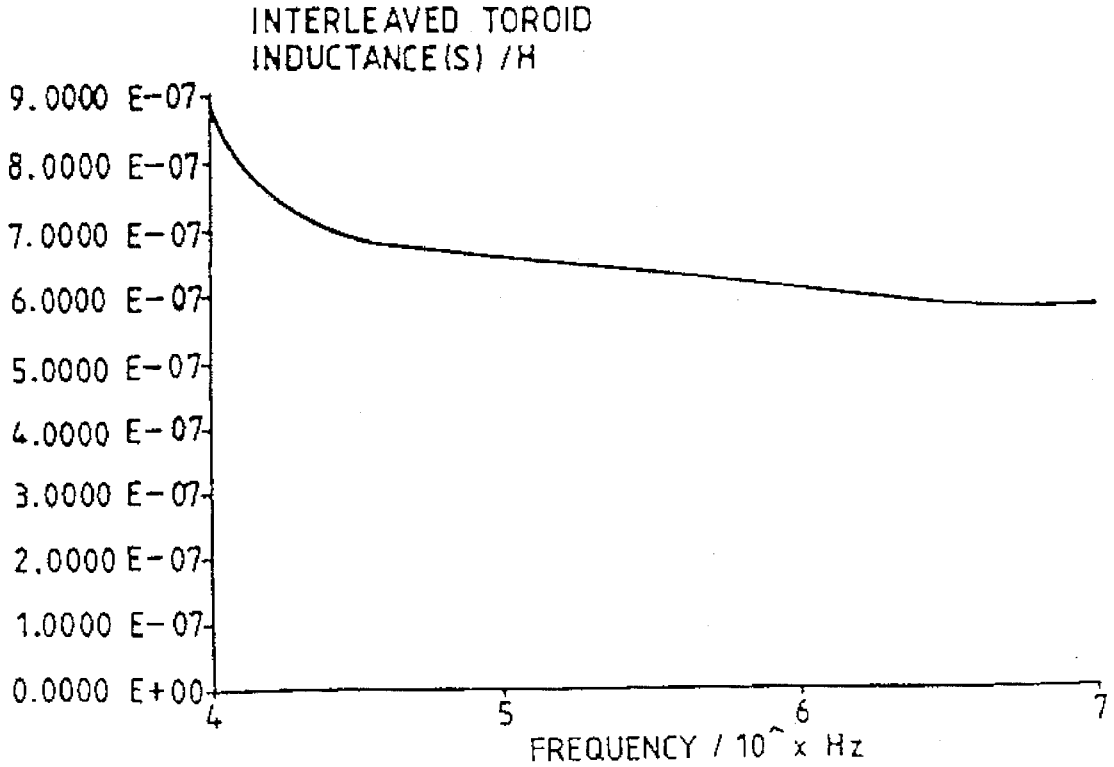

The completed transformer (FIG. 16(*a*) now consists of 12 primary turns P all connected in series, with connections outside the toroid, and two secondary windings, $S_1$, $S_2$, each with 12 paralleled turns, interleaved with the primary, with a common centre tap connection C, terminated in the centre of the toroid to give optimum current sharing in each secondary turn. Rectifier diodes (not shown) may be placed in the centre of the transformer so that the space is used and D.C. can be led out.

Figure 18:
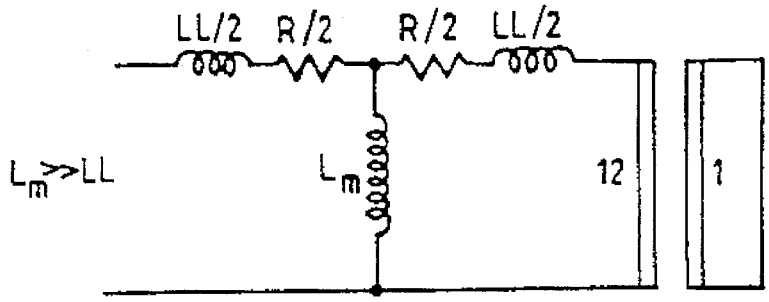
FIG. 18 is an electrical equivalent circuit for the transformer of FIG. 16(*a*), with one secondary winding short circuited.

A short circuit test has been carried out on the particular implementation of the present invention herein described, over an appropriate frequency range, and the results for winding resistance (FIG. 17(*d*)) and leakage inductance (FIG. 17(*d*)) are now compared against results for a commercially available 'planar magnetic' device. (FIGS. 17(*a*) and 17(*b*) respectively). (The short circuit transormer test is well known in electrical engineering and measures the values of the distributed components shown in the equivalent circuit (FIG. 18). 'Planar magnetics' in which the transformer takes the form of a very flat sandwich type device, as described earlier, with spiral windings, are presently regarded as the 'state of the art' for high frequency power transformers). Note that such spiral windings are not generally interleaved on one layer although according to this invention they can be (see FIG. 6(*d*)).

The planar transformer has six primary turns and one secondary turn. Hence the square of the primary to secondary turns ratio, which determines leakage inductance, is 36 as opposed to 144 for the present device. Nevertheless, at 1 MHz, the leakage inductance of the present transformer is only twice that of the planar structure, showing a two-to-one improvement.

Figure 19A:
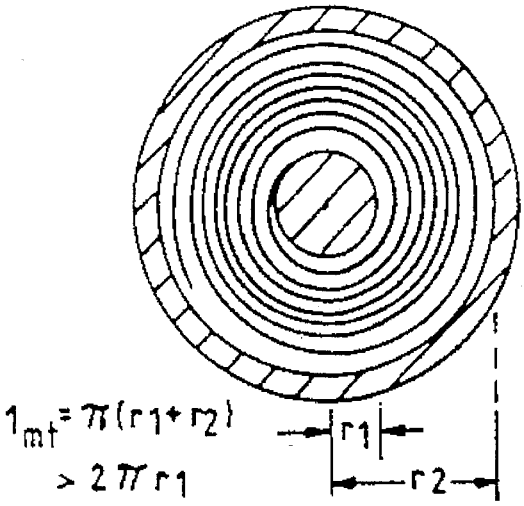
FIGS. 19(*a*) and 19(*b*) are diagrams showing the mean turn length of a conventional planar spiral transformer and of a transformer embodying the invention, respectively.
Figure 19B:
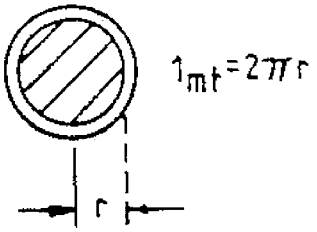

The series resistance of the planar component is 0.35Ω at 1 MHz rising sharply to 8Ω at 10 MHz due to severe proximity effect losses. Note that due to skin effect only the resistance should increase by a factor of $\sqrt{10}$ (=3.16), whereas it in fact increases by nearly 23 times. With the present transformer the resistance at 1 MHz is 0.59Ω. With twice as many primary turns one would expect four times the resistance; hence this represents a better than two-fold improvement. This is due to the fact that the mean turn length in the present device is less than that in the planar spiral case (FIG. 19). At 10 MHz this resistance has risen to 1.61Ω, an increase of 2.73 times which is attributable entirely to skin effect, showing the effective elimination of proximity effect obtainable with the present invention.

Figure 20A:
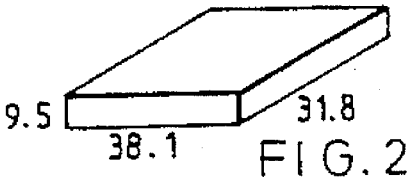
FIGS. 20(*a*) and 20(*b*) illustrate the dimensions respectively of the conventional planar spiral transformer and the transformer embodying the invention.
Figure 20B:
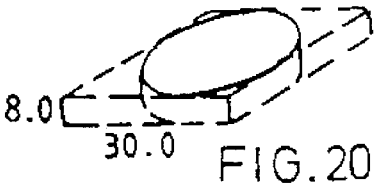
Figure 21:
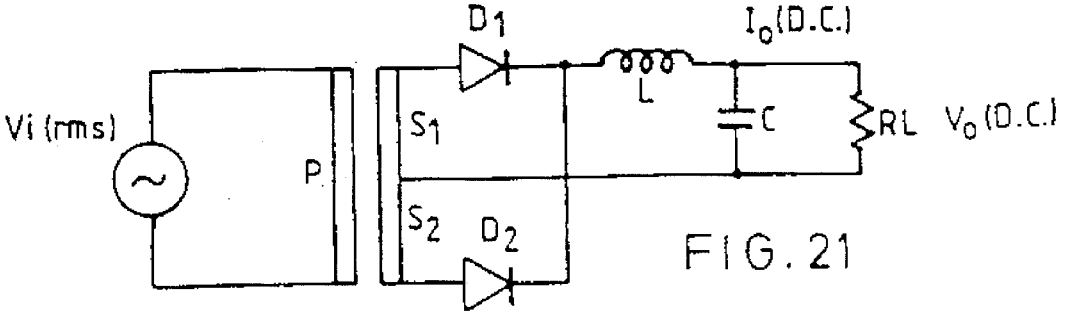
FIG. 21 is a test circuit diagram for the comparison of power transformers.

Overall dimensional drawings of the two transformers are given (FIG. 20). These drawings indicate a footprint area of 1210 $mm^2$ and a volume of 11492 $mm^3$ for the planar part with the present device occupying 707 $mm^2$ (or 900 $mm^2$ if considering square area) and 5656 $mm^3$ (or 7200 $mm^3$ if considering cube volume). Furthermore, the area/volume in the centre of the present device (included in figures) can be used for other components (e.g. rectifier diodes). Both transformers are designed to operate at frequencies around 1 MHz with a power throughput of about 150 W. Taking the circuit of FIG. 21 with a secondary RMS voltage of 6 V for a 5 V output, assuming 0.5 V diode drop, we have a secondary current (square wave) of 25A. Primary voltage for the planar component is 36 V (turns ratio=6), whereas it is 72 V rms for the present device. Hence, transformer has 6 V per turn with primary currents of 4.16A and 2.083A respectively.

Employing Faraday's Law:

$$\text{Main flux, peak flux density } \hat{B} = \frac{V_{rms}\sqrt{2}}{2\pi f N Ae}$$

where Ae=129 $mm^2$, planar and 39 $mm^2$, present gives $\hat{B}$ planar= 10.47 mT, $\hat{B}$ present=34.63 mT.

For a typical high frequency power ferrite, specific power loss at 1 MHz will then be 5 mW per gram, planar, 88 mW per gram, present. The planar transformer has a core volume of 4920 $mm^3$, the present core volume being 2140 $mm^3$. With a typical ferrite density of $4.7\times10^{-3}$ $gm^{-3}$, total core losses are 116 mW and 885 mW respectively. Total winding losses ($I^2R$) are 6.08 and 2.56 W giving overall losses of 6.2 and 3.45 W respectively. The present transformer is clearly more efficient in this application and, despite its smaller footprint, has a similar heat dissipation to footprint ratio (about 5 mW per $mm^2$).

If we consider the two transformers operating at 10 MHz, core losses become negligible (14 mW, 109 mW respectively) because of the drop in flux density. However, winding losses now become 139 W and 6.9 W respectively indicating that the present device can still be used, whereas the planar component is entirely unsuitable.

Figure 22:
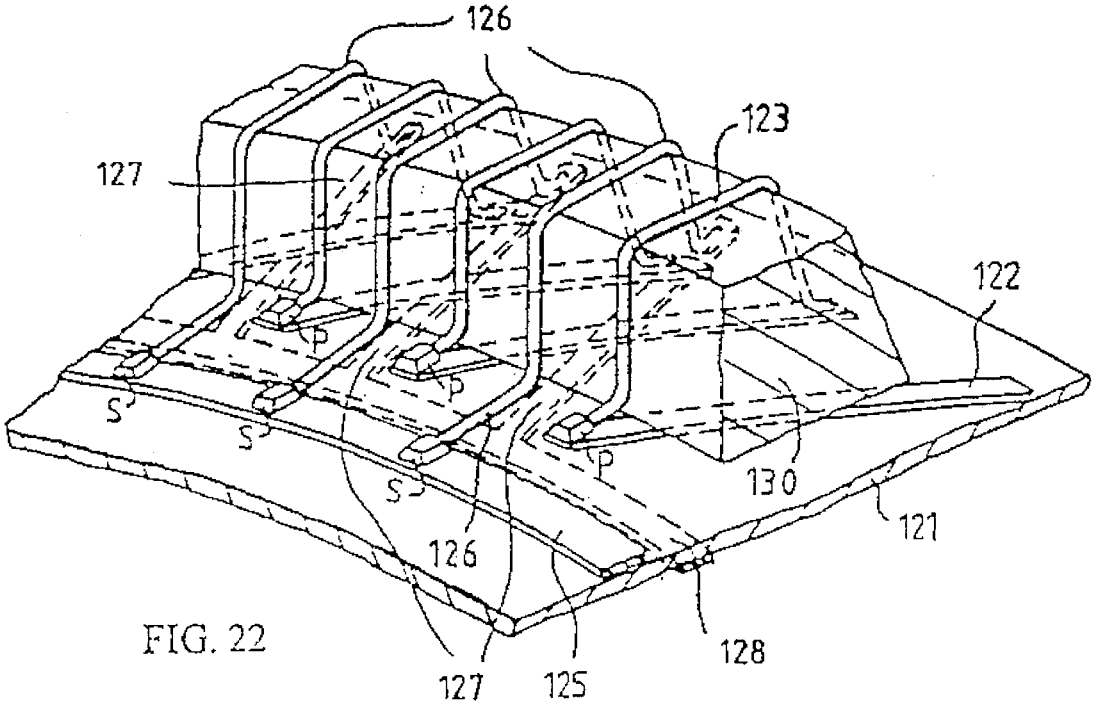
FIG. 22 is a perspective view of a section of a toroidal transformer embodying the claimed invention.
Figure 23:
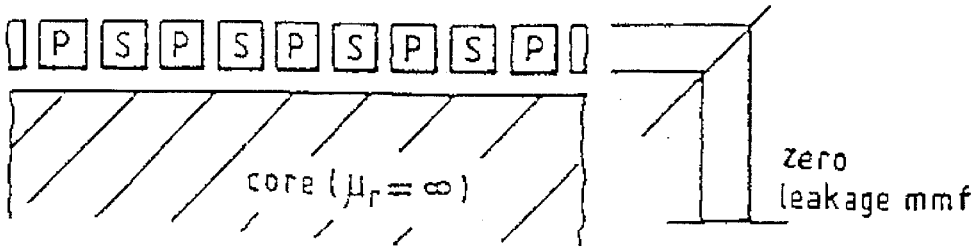
FIG. 23 is a diagram of a partial section of a toroidal transformer embodying the claimed invention with and adjacent graph illustrating the leakage mmf distribution.
Figure 24:
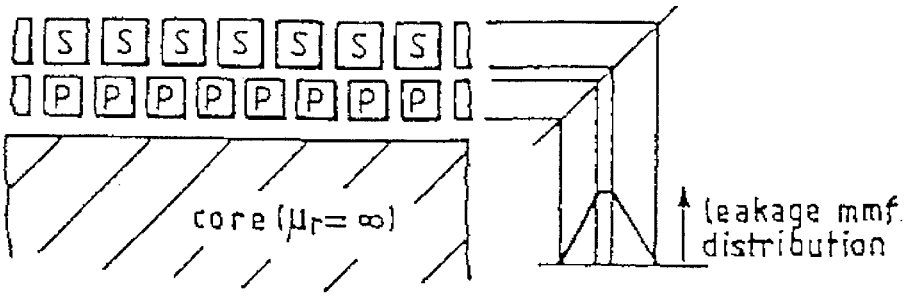
FIG. 24 is a diagram of a partial section of a conventional transformer with an adjacent graph illustrating the leakage mmf distribution.

The toroidal transformer of FIGS. 22 and 23 comprises a substrate 121 to which is bonded on one face a toroidal core 130. Series-connected primary turns are formed from substrate metallization strips 122 between which are bonded wire loops 123. Parallel-connected secondary turns are formed between substrate metallization strips 125, on the upper face of the substrate, and 128, on the underside of the substrate, constituting secondary terminals. Each of a series of parallel metallization strips 127 on the underside of the substrate is connected at one end to the secondary terminal 128 and at the other end to a wire 126 which loops over the core 130 to the other secondary terminal 125. Thus, it can be seen that the primary physical turns 123 are interleaved with the secondary physical turns 126 on the same winding layer.

To summarise, therefore, the advantages of the invention derive from a power transformer or coupled inductor employing interleaving of individual primary and secondary physical turns on one or more layers around a permeable or air core to give optimal coupling and minimal magnetic leakage, with the resultant virtual elimination of proximity effect losses. In one form of power transformer or coupled inductor as described, the physical turns thereof are appropriately sized so as to eliminate skin effect losses. Such a transformer or coupled inductor preferably employs a toroidal core on which the sum of the mutual magnetic couplings between any one physical turn, and all the other turns, is identical for each turn, leading to optimal current distribution in the windings. Additionally, in the transformer or coupled inductor which may or may not use a toroidal core, the core is preferably shaped to facilitate 'winding', and preferably printed, etched, plated or otherwise formed conducting tracks on a substrate form part of the windings, the turns being completed by conducting wire or ribbon bonds (which may or may not be placed on an insulating former) or by conducting punched, etched or otherwise formed preforms or by printed, etched, plated or otherwise formed conductors on a shaped or flexible substrate. Alternatively, part or all of each or any turn are formed by printed, etched, plated or otherwise devised conductors on the core itself. Furthermore, a step-down transformer or coupled inductor embodying the invention, preferably with a toroid core, may have a multi-turn primary (e.g. N turns in series) and a single turn secondary (e.g. N turns in parallel) with the secondary terminated (e.g. by rectifier diode/s) in the centre of the toroid to give optimal current sharing in the paralleled secondary turns. Additionally, multi-turn and multiple secondary windings can also be made, using series and parallel combinations of turns with minimal leakage flux and a.c. resistance. Non-optimal solutions also exist, which may be more suitable for practical implementation. Alternatively in the step-up transformer or coupled inductor, the primary is driven (e.g. by a switching device/s) in the centre of the core.

Reference

[1] P. L. Dowell: "Effects Of Eddy Currents in Transformer Windings", Proceedings of the IEE, Vol. 113, No. 8, August 1968, pp 1387–1394.

We claim:

1. A transformer having an arbitrary turns ratio, comprising:

a primary physical turn and a secondary physical turn, the primary and secondary physical turns are not bifilar and are interleaved on the same winding layer; and a transformer core having portions, the primary and secondary physical turns being distributed over the portions of the transformer core with each portion containing turns from all the windings of the transformer, the primary and secondary physical turns on the same winding layer being substantially the same distance from the transformer core;

such that, in each portion of the transformer core, in use, mmf driving leakage flux is minimized.

2. A transformer according to claim 1 in which the core is toroidal and the portions are equi-angular.

3. A transformer according to claim 1 in which the turns ratio is non-integral.

4. A transformer according to claim 1 in which the turns ratio is other than unity.

5. A transformer according to claim 1 in which the primary and secondary turns are interleaved around a core selected from the group consisting of a magnetically permeable core or an air core.

6. A transformer according to claim 1 in which each winding consists of physical turns of conductive material around a core, and in which the electrical turns ratio is determined by the physical turns of each winding having connections selected from the group consisting of series connections, parallel connections or combination series-parallel connections.

7. A transformer according to claim 1, in which more than one such layer of interleaved turns is provided and in which, for each winding layer, the turns are substantially the same distance from the core transformer.

8. A transformer according to claim 1 in which a portion of at least one physical turn is comprised of a conductor formed on a substrate material.

9. A transformer according to claim 8, wherein the physical turn is formed as a loop of conductive material over the core where such material is bonded at each end to the respective conductor which is formed on the substrate.

10. A transformer according to claim 1 in which at least one of the windings is terminated in a region surrounded by the core thereof around which the primary and secondary turns of those windings are interleaved.

11. A transformer according to claim 1, wherein each physical turn is formed on a substrate material selected from the group consisting of printing, etching or plating conductive material.

12. A transformer according to claim 1, wherein at least one physical turn is formed as a conductor on a core around which the primary and secondary turns are interleaved.

13. A transformer according to claim 1 in which there is a plurality of the secondary windings formed from suitably interconnected corresponding ones of the interleaved secondary physical turns.

14. A coupled inductor having an arbitrary turns ratio, comprising:

a primary physical turn and a secondary physical turn, the primary and secondary physical turns are not bifilar and are interleaved on the same winding layer; and an inductor core having portions, the primary and secondary physical turns being distributed over the portions of the inductor core with each portion containing turns from all the windings of the inductor, the primary and secondary physical turns on the same winding layer being substantially the same distance from the inductor core;

such that, in each portion of the inductor core, if used as a transformer, mmf driving leakage flux is minimized.

15. A coupled inductor according to claim 14 in which the core is toroidal and the portions are equi-angular.

16. A coupled inductor according to claim 14 in which at least one of the windings is terminated in a region surrounded by the core thereof around which the primary and secondary turns of those windings are interleaved.

17. A transformer or coupled inductor with arbitrary turns ratio, in which the primary and secondary physical turns are interleaved on the same winding layer, further comprising at least one electrical circuit component situated in a region surrounded by a core of the transformer or coupled inductor and in which said turns are adapted for connection to said at least one circuit component.

18. A transformer according to claim 17, wherein each physical turn is formed on each of a number of substrate layers, and thermally conducting vias are provided to connect the different layers.

19. A transformer or coupled inductor with arbitrary turns ratio, with superimposed winding layers in which the primary and secondary physical turns are interleaved both within each of the layers and also from layer to superimposed layer, and in which, within each winding layer, the turns are substantially the same distance from a core.

20. A transformer or coupled inductor according to claim 19, in which at least one of the windings is terminated in a region surrounded by the core thereof around which the primary and secondary turns of those windings are interleaved.

21. A transformer or a coupled inductor according to claim 19, wherein each physical turn is formed on each of a number of substrate layers, and thermally conducting vias are provided to connect the different layers.

* * * * *